US007414016B1

(12) United States Patent
van Buskirk et al.

(10) Patent No.: US 7,414,016 B1
(45) Date of Patent: Aug. 19, 2008

(54) ACIDIC CLEANING COMPOSITIONS

(75) Inventors: Gregory van Buskirk, Danville, CA (US); Aram Garabedian, Fremont, CA (US); Ryan K. Hood, Dublin, CA (US); Stephen Bradford Kong, Alamo, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 11/933,807

(22) Filed: Nov. 1, 2007

(51) Int. Cl.
*C11D 3/22* (2006.01)
*C11D 3/50* (2006.01)
*C11D 7/08* (2006.01)

(52) U.S. Cl. ..... 510/199; 510/101; 510/191; 510/235; 510/238; 510/239; 510/240; 510/470; 510/474; 510/477; 510/533

(58) Field of Classification Search ..... 510/101, 510/191, 199, 235, 238, 239, 240, 470, 474, 510/477, 533
See application file for complete search history.

(56) References Cited

U.S. PATENT DOCUMENTS

| | | | | |
|---|---|---|---|---|
| 5,025,069 | A | 6/1991 | Deguchi et al. | |
| 5,230,823 | A | 7/1993 | Wise et al. | |
| 5,234,719 | A | 8/1993 | Richter et al. | |
| 5,356,479 | A | 10/1994 | Menke et al. | |
| 5,403,587 | A | 4/1995 | McCue et al. | |
| 5,705,472 | A | 1/1998 | Hayes et al. | |
| 5,780,416 | A | 7/1998 | Kiewert et al. | |
| 5,849,681 | A | 12/1998 | Neumiller et al. | |
| 5,851,980 | A | 12/1998 | Avery | |
| 5,972,857 | A | 10/1999 | Roselle et al. | |
| 5,998,358 | A | 12/1999 | Herdt et al. | |
| 6,087,319 | A | 7/2000 | Norman | |
| 6,121,228 | A | 9/2000 | Drapier et al. | |
| 6,153,572 | A | 11/2000 | Stamm | |
| 6,302,969 | B2 | 10/2001 | Moster et al. | |
| 6,369,013 | B1 * | 4/2002 | Gambogi et al. | 510/237 |
| 6,420,326 | B1 | 7/2002 | Maile et al. | |
| 6,559,111 | B2 | 5/2003 | Colurciello, Jr. et al. | |
| 6,689,223 | B1 | 2/2004 | Meine et al. | |
| 6,740,626 | B2 | 5/2004 | Neumiller | |
| 6,786,223 | B2 | 9/2004 | Klinkhammer et al. | |
| 6,794,346 | B2 | 9/2004 | Wick et al. | |
| 6,831,050 | B2 | 12/2004 | Murch et al. | |
| 7,030,070 | B2 | 4/2006 | Sakurai et al. | |
| 7,182,950 | B2 | 2/2007 | Garti et al. | |
| 2002/0031966 | A1 | 3/2002 | Tomarchio et al. | |
| 2003/0143909 | A1 | 7/2003 | Barnabas et al. | |
| 2005/0155630 | A1 | 7/2005 | Kilkenny et al. | |

FOREIGN PATENT DOCUMENTS

| | | |
|---|---|---|
| WO | WO0000026 | 1/2000 |
| WO | WO 00/17303 | 3/2000 |
| WO | WO2005/091981 | 10/2005 |
| WO | WO2006131690 | 12/2006 |

* cited by examiner

*Primary Examiner*—Brian P Mruk
(74) *Attorney, Agent, or Firm*—David Peterson

(57) ABSTRACT

A cleaning composition with a limited number of natural ingredients contains alkyl polyglucoside, a 2-hydroxycarboxylic acid, and a fragrance containing lemon oil or d-limonene. The cleaning composition optionally has a small amount of dye, colorant, and preservative. The cleaning composition can be used to clean hard surfaces and cleans as well or better than commercial compositions containing synthetically derived cleaning agents.

21 Claims, No Drawings

ACIDIC CLEANING COMPOSITIONS

BACKGROUND OF THE INVENTION

1. Field of the Invention

The present invention relates generally to acidic cleaning compositions for use on hard surfaces. The compositions also relate to natural cleaning compositions having a limited number of ingredients and having good cleaning properties and low residue.

2. Description of the Related Art

Cleaning formulations have progressed and created a large chemical industry devoted to developing new synthetic surfactants and solvents to achieve ever improving cleaning compositions for the consumer. Because of a desire to use renewable resources, natural based cleaners are gaining increasing interest. Most of these cleaners contain only some natural ingredients. One difficulty in formulating natural based cleaners is achieving acceptable consumer performance with a limited number of natural components compared to highly developed formulations using synthetic surfactants and solvents.

Typical cleaning formulations require multiple surfactants, solvents, and builder combinations to achieve adequate consumer performance. For example, U.S. Pat. No. 5,025,069 to Deguchi et al. discloses alkyl glycoside detergent systems with anionic, amphoteric and nonionic surfactant ingredients. U.S. Pat. No. 7,182,950 to Garti et al. discloses nano-sized concentrates with examples using Tween® surfactants. U.S. Pat. No. 6,831,050 to Murch et al. discloses toxicologically acceptable cleaners containing oleic acid and citric acid. U.S. Pat. No. 6,302,969 to Moster et al. discloses natural cleaners containing anionic surfactants. U.S. Pat. No. 6,420,326 to Maile et al. discloses glass cleaners with ethanol, glycol ethers, and anionic surfactants. PCT App. WO 00/00026 to Self et al. discloses antimicrobial compositions containing surfactants and organic acids in which hydrotropes are needed to solubilize perfume materials and stabilize the antimicrobial composition.

Prior art compositions do not combine effective cleaning with a minimum number of ingredients, especially with natural ingredients. It is therefore an object of the present invention to provide a cleaning composition that overcomes the disadvantages and shortcomings associated with prior art cleaning compositions.

SUMMARY OF THE INVENTION

In accordance with the above objects and those that will be mentioned and will become apparent below, one aspect of the present invention comprises an acidic hard surface cleaning composition comprising greater than 2% alkyl polyglucoside; 0.5 to 10% 2-hydroxycarboxylic acid; a fragrance containing 0.05 to 2.0% lemon oil or d-limonene; water; and optionally dyes, colorants, and preservatives; wherein the composition contains substantially no additional surfactant, no additional organic builder, no organic solvent, and no additional disinfectant or sanitizer such as quaternary ammonium antimicrobial or biguanide; and wherein the pH is between 2 and 3.5.

In accordance with the above objects and those that will be mentioned and will become apparent below, another aspect of the present invention comprises a hard surface cleaning composition comprising 2 to 10% alkyl polyglucoside; 0.5 to 10% 2-hydroxycarboxylic acid; a fragrance containing 0.05 to 2.0% lemon oil or d-limonene; 0.1 to 2.0% xanthan gum; water; and optionally dyes, colorants, and preservatives; wherein the composition contains no additional surfactant, no additional organic builder, no organic solvent, and no additional disinfectant or sanitizer such as quaternary ammonium antimicrobial or biguanide; and wherein the pH is between 2 and 3.5.

In accordance with the above objects and those that will be mentioned and will become apparent below, another aspect of the present invention comprises a hard surface cleaning composition consisting essentially of 2 to 10% alkyl polyglucoside; 0.5 to 10% 2-hydroxycarboxylic acid; a fragrance containing 0.05 to 2.0% lemon oil or d-limonene; optionally a cellulosic thickener; optionally dyes, colorants, and preservatives, wherein the dyes, colorants and preservatives are not derived from petrochemicals; water; wherein the pH is between 2 and 3.5.

Further features and advantages of the present invention will become apparent to those of ordinary skill in the art in view of the detailed description of preferred embodiments below, when considered together with the attached claims.

DETAILED DESCRIPTION OF THE INVENTION

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition alone, not accounting for the substrate weight. Each of the noted cleaner composition components and substrates is discussed in detail below.

The term "cleaning composition", as used herein, is meant to mean and include a cleaning formulation having at least one surfactant.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic and/or amphoteric agents.

Alkyl Polyglucoside

The cleaning compositions contain alkyl polyglucoside surfactant. The alkyl polyglucoside surfactant preferably has a naturally derived alkyl substituent, such as coconut fatty alcohol. The alkyl polyglucoside is preferably made from renewable resources and preferably has no petroleum derived components, such as ethoxylate or propoxylate. The cleaning compositions preferably have an absence of other nonionic surfactants, especially petroleum derived nonionic surfactants, such as nonionics based on synthetic alcohols or ethoxylates. The cleaning compositions preferably have an absence of other surfactants or substantially no additional surfactant, such as anionic, nonionic, cationic, and amphoteric surfactants. Many other surfactants, such as nonionic esters, anionic sulfates, and amphoteric sarcosinates are unstable in the inventive compositions.

Suitable alkyl polyglucoside surfactants are the alkylpolysaccharides that are disclosed in U.S. Pat. No. 5,776,872 to Giret et al.; U.S. Pat. No. 5,883,059 to Furman et al.; U.S. Pat. No. 5,883,062 to Addison et al.; and U.S. Pat. No. 5,906,973 to Ouzounis et al., which are all incorporated by reference. Suitable alkyl polyglucosides for use herein are also disclosed in U.S. Pat. No. 4,565,647 to Llenado describing alkylpolyglucosides having a hydrophobic group containing from about 6 to about 30 carbon atoms, or from about 10 to about 16 carbon atoms and polysaccharide, e.g., a polyglycoside (polyglucoside), hydrophilic group containing from about 1.3 to about 10, or from about 1.3 to about 3, or from about 1.3 to about 2.7 saccharide units. Optionally, there can be a polyalkyleneoxide chain joining the hydrophobic moiety and the polysaccharide moiety. A suitable alkyleneoxide is ethylene oxide. Typical hydrophobic groups include alkyl groups, either saturated or unsaturated, branched or unbranched containing from about 8 to about 18, or from about 10 to about 16, carbon atoms. Suitably, the alkyl group can contain up to about 3 hydroxy groups and/or the polyalkyleneoxide chain can contain up to about 10, or less than about 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

Suitable alkylpolyglycosides (or alkylpolyglucosides) have the formula: $R^2O(C_nH_{2n}O)_t(\text{glucosyl})_x$ wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is about 2 or about 3, preferably about 2; t is from 0 to about 10, preferably 0; and x is from about 1.3 to about 10, preferably from about 1.3 to about 3, most preferably from about 1.3 to about 2.7. The glucosyl is preferably derived from glucose. To prepare these compounds, the alcohol or alkylpolyethoxy alcohol is formed first and then reacted with glucose, or a source of glucose, to form the glucoside (attachment at the 1-position). The additional glucosyl units can then be attached between their 1-position and the preceding glucosyl units 2-, 3-, 4- and/or 6-position, preferably predominantly the 2-position.

A group of alkyl glycoside surfactants suitable for use in the practice of this invention may be represented by formula I below:

$$RO—(R^2O)_y—(G)_xZ_b \qquad \text{I}$$

wherein R is a monovalent organic radical containing from about 6 to about 30 (preferably from about 8 to about 18) carbon atoms; $R^2$ is a divalent hydrocarbon radical containing from about 2 to about 4 carbon atoms; O is an oxygen atom; y is a number which has an average value from about 0 to about 1 and is preferably 0; G is a moiety derived from a reducing saccharide containing 5 or 6 carbon atoms; and x is a number having an average value from about 1 to 5 (preferably from 1.1 to 2); Z is $O_2M^1$, $O_2CR^3$, $O(CH_2)_p$, $CO_2M^1$, $OSO_3M^1$, or $O(CH_2)_pSO_3M^1$; $R^3$ is $(CH_2)_pCO_2M^1$ or $CH{=}CHCO_2M^1$; (with the proviso that Z can be $O_2M^1$ only if Z is in place of a primary hydroxyl group in which the primary hydroxyl-bearing carbon atom, $—CH_2OH$, is oxidized to form a $—CO_2M^1$ group); b is a number from 0 to 3x+1 preferably an average of from 0.5 to 2 per glucosal group; p is 1 to 10, $M^1$ is $H^+$ or an organic or inorganic cation, such as, for example, an alkali metal, ammonium, monoethanolamine, or calcium. As defined in Formula I, R is generally the residue of a fatty alcohol having from about 8 to 30 or 8 to 18 carbon atoms. Suitable alkylglycosides include, for example, APG 425® (a coconut alkyl polyglycoside having naturally derived components available from Cognis Corporation), APG 325® (a $C_9$-$C_{11}$ alkyl polyglycoside available from Cognis Corporation), APG 625® (a $C_{10}$-$C_{16}$ alkyl polyglycoside available from Cognis Corporation), Dow Triton® CG110 (a $C_8$-$C_{10}$ alkyl polyglycoside available from Dow Chemical Company), AG6202® (a $C_8$ alkyl polyglycoside available from Akzo Nobel) and Alkadet 15® (a $C_8$-$C_{10}$ alkyl polyglycoside available from Huntsman Corporation). A $C_8$ to $C_{10}$ alkylpolyglucoside includes alkylpolyglucosides wherein the alkyl group is substantially C8 alkyl, substantially C10 alkyl, or a mixture of substantially C8 and C10 alkyl. Suitably, the alkyl polyglycoside is present in the cleaning composition in an amount ranging from about 0.01 to about 30 weight percent, or 0.1 to 30 weight percent, or 10 to 30 weight percent, or 1 to 5 weight percent, or 2 to 5 weight percent, or 0.5 to 5 weight percent, or 0.5 to 4 weight percent, or 0.5 to 3 weight percent, or 0.5 to 2.0 weight percent, or 0.1 to 0.5 weight percent, or 0.1 to 1.0 weight percent, or 0.1 to 2.0 weight percent, or 0.1 to 3.0 weight percent, or 0.1 to 4.0 weight percent, or greater than 2 weight percent, or greater than 3 weight percent.

2-Hydroxycarboxylic Acids

One aspect of the invention is a 2-hydroxycarboxylic acid or mixture of 2-hydroxycarboxylic acids. Examples of 2-hydroxycarboxylic acids are given in Table I. 2-Hydroxycarboxylic acids also include polymeric forms of 2-hydroxycarboxylic acid, such as polylactic acid. Since other organic builders are not substantially present, significant amounts of 2-hydroxycarboxylic acids are required. Suitable compositions comprise 2-hydroxycarboxylic acids in concentrations of 0.5 to 50% by weight, or 0.5 to 20% by weight, or 0.5 to 10% by weight, or 0.5 to 5% by weight, or 0.5 to 4% by weight, or 0.5 to 3% by weight, or 0.5 to 2% by weight.

TABLE 1

| 2-Hydroxyacids | |
|---|---|
| Tartaric acid | 2,3-dihydroxy succinic acid |
| Citric acid | 2-hydroxy propanetricarboxylic acid |
| Malic acid | 2-hydroxy succinic acid |
| Mandelic acid | 2-hydroxy phenylacetic acid |
| Glycolic acid | 2-hydroxy acetic acid |
| Lactic acid | 2-hydroxy propionic acid |

Fragrances Containing Lemon Oil and d-Limonene

The cleaning compositions contain fragrances containing d-limonene or lemon oil; or natural essential oils or fragrances containing d-limonene or lemon oil. Lemon oil or d-limonene helps the cleaning performance characteristics of the cleaning composition to allow suitable consumer performance with natural ingredients and a minimum of ingredients. Lemon oil and d-limonene compositions which are useful in the invention include mixtures of terpene hydrocarbons obtained from the essence of oranges, e.g., cold-pressed orange terpenes and orange terpene oil phase ex fruit juice, and the mixture of terpene hydrocarbons expressed from lemons and grapefruit. The essential oils may contain minor, non-essential amounts of hydrocarbon carriers. Suitably, the fragrance contains lemon oil or d-limonene in the cleaning composition in an amount ranging from about 0.01 to about 0.50 weight percent, or 0.01 to 0.40 weight percent, or 0.01 to 0.30 weight percent, or 0.01 to 0.25 weight percent, or 0.01 to 0.20 weight percent, or 0.01 to 0.10 weight percent, or 0.05 to 2.0 weight percent, or 0.05 to 1.0 weight percent, or 0.5 to 1.0 weight percent, or 0.05 to 0.40 weight percent, or 0.05 to 0.30 weight percent, or 0.05 to 0.25 weight percent, or 0.05 to 0.20 weight percent, or 0.05 to 0.10 weight percent.

Water

When the composition is an aqueous composition, water can be a predominant ingredient. The water should be present at a level of less than 99.9 weight percent, more preferably less than about 99 weight percent, and most preferably, less than about 98 weight percent. Deionized or filtered water is preferred. Where the cleaning composition is concentrated, the water may be present in the composition at a concentration of less than about 85 wt. %.

Natural Thickener

The present compositions can also comprise an auxiliary nonionic or anionic polymeric thickening component, especially cellulose thickening polymers, especially a water-soluble or water dispersible polymeric materials, having a molecular weight greater than about 20,000. By "water-soluble or water dispersible polymer" is meant that the material will form a substantially clear solution in water at a 0.5 to 1 weight percent concentration at 25° C. and the material will increase the viscosity of the water either in the presence or absence of surfactant. Examples of water-soluble polymers which may desirably be used as an additional thickening component in the present compositions, are hydroxyethylcellulose, hydroxypropyl cellulose, hydroxypropyl methylcellulose, dextrans, for example Dextran purified crude Grade 2P, available from D&O Chemicals, carboxymethyl cellulose, plant exudates such as acacia, ghatti, and tragacanth, seaweed extracts such as sodium alginate, and sodium carrageenan. Preferred as the additional thickeners for the present compositions are natural polysaccharide or cellulose materials. Examples of such materials are guar gum, locust bean gum, and xanthan gum. Also suitable herein preferred is hydroxyethyl cellulose having a molecular weight of about 700,000. The thickeners are generally present in amounts of 0.05 to 2.0 weight percent, or 0.1 to 2.0 weight percent.

Dyes, Colorants and Preservatives

The cleaning compositions optionally contain dyes, colorants and preservatives, or contain one or more, or none of these components. These dyes, colorants and preservatives can be natural (occurring in nature or slightly processed from natural materials) or synthetic. Natural preservatives include benzyl alcohol, potassium sorbate and bisabalol; sodium benzoate and 2-phenoxyethanol. Preservatives, when used, include, but are not limited to, mildewstat or bacteriostat, methyl, ethyl and propyl parabens, bisguanidine compounds (e.g. Dantagard and/or Glydant). The mildewstat or bacteriostat includes, but is not limited to, mildewstats (including non-isothiazolone compounds) including Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1,3 diol, from Boots Company Ltd., PROXEL CRL, a propyl-p-hydroxybenzoate, from ICI PLC; NIPASOL M, an o-phenyl-phenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G. Dyes and colorants include synthetic dyes such as Liquitint® Yellow or Blue or natural plant dyes or pigments, such as a natural yellow, orange, red, and/or brown pigment, such as carotenoids, including, for example, beta-carotene and lycopene.

pH

The pH of the cleaning composition is measured directly without dilution. The cleaning compositions can have a pH of between 2 and 4, or between 2 and 3, or between 2.5 and 3.5, or between 2 and 3.5.

Builder

The cleaning compositions contain no, or substantially no, additional organic builder other than 2-hydroxycarboxylic acids. Specifically, carboxylic acids other than 2-hydroxycarboxylic acids do not add to the performance and can hurt the long term stability of the formulations. Other organic builders include acetic acid, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxy-sulfonates, starch derivatives, amino acids such as lysine, are tri(hydroxymethyl)amino methane (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diaminopropanol N,N'-tetra-methyl-1,3-diamino-2-propanol, N,N-bis(2-hydroxyethyl)glycine (bicine), N-tris(hydroxymethyl)methyl glycine (tricine), monoethanolamine, monopropanolamine, diethanolamine, dipropanolamine, triethanolamine, and 2-amino-2-methylpropanol. The cleaning compositions preferably contain no inorganic builders, such as alkali metal carbonate, alkali metal bicarbonate, alkali metal hydroxide, alkali metal phosphate, alkali metal silicate, phosphate-silicate compounds, and zeolites. Other inorganic builders include alkali metal and alkaline earth salts of silicate encompassing silicate, metasilicate, polysilicate, aluminosilicate and similar compounds, metasilicate, polysilicate, borate, hydroxide, carbonate, carbamate, phosphate, polyphosphate, pyrophosphates, triphosphates, tetraphosphates, and ammonia. However, small amounts may sometimes be appropriate. Strong mineral acids and bases such as hydrochloric acid, sulfuric acid, and hydroxide are frequently used for pH adjustment and are not considered buffers.

Solvent

The cleaning compositions contain no, or substantially no, organic solvents. Contrary to prior art suggestions, organic solvents generally to not add to the cleaning performance and can create environmental issues because they are frequently VOCs.

Examples of organic solvents include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water-soluble solvent when employed.

Disinfectant or Sanitizer

The cleaning compositions contain no, or substantially no, additional disinfectants or sanitizers, such as quaternary ammonium antimicrobials or biguanides. Although the compositions may contain minor amounts of traditional antimicrobials as preservatives or other uses, the compositions are without the use of traditional quaternary ammonium compounds or phenolics. Non-limiting examples of these quaternary compounds include benzalkonium chlorides and/or substituted benzalkonium chlorides, di(C6-C14)alkyl di short chain (C1-4 alkyl and/or hydroxyalkl) quaternaryammonium salts, N-(3-chloroallyl) hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethylenzylmmonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are also in this class.

Surface Modifying Agents

Although the compositions contain polyglycoside surfactants which lower the surface energy during cleaning, the compositions generally contain no surface modifying agents, which provide a lasting surface modification to the cleaning surface. The surface modifying agents are generally polymers other than the cellulosic thickening polymers and provide spreading of the water on the surface or beading of water on the surface, and this effect is seen when the surface is rewetted and even when subsequently dried after the rewetting. Examples of surface modifying agents include polymers and co-polymers of N,N-dimethyl acrylamide, acrylamide, and certain monomers containing quaternary ammonium groups or amphoteric groups that favor substantivity to surfaces, along with co-monomers that favor adsorption of water, such as, for example, acrylic acid and other acrylate salts, sulfonates, betaines, and ethylene oxides. Other examples include organosilanes and organosilicone polymers, cationic polymers, hydrophobic amphoteric polymers, nanoparticles and hydrophobic organic polymers, such as waxes.

Cleaning Substrate

The cleaning composition is generally not impregnated in a cleaning substrate. Because of the limited number of ingredients, these compositions tend to perform better when used with a substrate at the time of application or use, and not sold as a pre-wetted substrate. Examples of unsuitable substrates include, nonwoven substrates, wovens substrates, hydroentangled substrates, foams and sponges and similar materials which can be used alone or attached to a cleaning implement, such as a floor mop, handle, or a hand held cleaning tool, such as a toilet cleaning device. The terms "nonwoven" or "nonwoven web" means a web having a structure of individual fibers or threads which are interlaid, but not in an identifiable manner as in a knitted web.

EXAMPLES

The compositions are simple, natural, high performance cleaning formulations with a minimum of essential natural ingredients. Competitive cleaners are either natural and inferior in performance or contain additional ingredients that make them non-natural, such as surfactants based on nonrenewable petrochemicals. Because preservatives, dyes and colorants are used in such small amounts, these may be synthetic and the entire composition may still be characterized as natural. Preferably, the compositions contain only natural preservatives, dyes, and colorants, if any.

Table II illustrates general bathroom cleaners of the invention. Table III illustrates manual toilet bowl cleaners (MTBC) of the invention. Table IV illustrates additional cleaning compositions of the invention. Table V shows that the compositions of the invention give superior CMSA soil performance to commercial natural cleaning compositions. (all numbers in weight percent of active ingredients)

TABLE II

| Bathroom Cleaner | A | B | C | D | E | F |
|---|---|---|---|---|---|---|
| Glucopon ® 425N[1] | 3.00 | 3.00 | 3.00 | 3.00 | 2.50 | 5.00 |
| Glycolic acid | 0.95 | 1.50 | | | | 0.50 |
| Citric acid | | | 5.00 | 5.00 | 10.00 | |
| Lactic acid | | | 1.50 | | | |
| Lemon oil | 0.20 | 0.20 | 0.20 | 0.20 | 0.05 | 0.40 |
| Water | balance | balance | balance | balance | balance | balance |

[1]Coco glucoside from Cognis.

TABLE III

| MTBC | G | H | I | J | K | L |
|---|---|---|---|---|---|---|
| Glucopon ® 425N | 4.50 | 4.50 | 4.50 | 4.00 | 9.00 | 2.00 |
| Glycolic acid | 0.95 | | | 1.50 | 0.50 | |
| Citric acid | | 5.00 | 5.00 | | | 9.50 |
| Lactic acid | | 1.70 | | | | |
| Xanthan gum | 0.70 | 0.60 | 0.70 | 0.50 | 0.10 | 1.80 |
| Lemon oil | 0.75 | 0.70 | 0.20 | 0.20 | 1.75 | 0.05 |
| Water | balance | balance | balance | balance | balance | balance |

TABLE IV

| Cleaners | M | N | O | P |
|---|---|---|---|---|
| Glucopon ® 215[1] | 2.00 | | | 2.00 |
| Glucopon ® 225[2] | | 1.50 | | |
| Glucopon ® 325[3] | | | 0.50 | |
| Glucopon ® 600[4] | | | | |
| Glycolic acid | 0.90 | 1.00 | 1.00 | 1.00 |
| D-Limonene | | 0.15 | 0.10 | 0.05 |
| D-Limonene with Essential oil | 0.20 | | | |
| Preservative and Dye/Colorant | 0.005 | 0.005 | 0.005 | 0.005 |
| Water | balance | balance | balance | balance |

[1]Capryl glucoside from Cognis.
[2]Decyl glucoside from Cognis.
[3]C9-C11 glucoside from Cognis.
[4]Lauryl glucoside from Cognis.

TABLE V

| Cleaner | CMSA Performance |
|---|---|
| Formula A | Superior |
| Formula B | Superior |
| Formula C | Superior |
| Formula D | Superior |
| Seventh Generation ® Bathroom Cleaner | Inferior |
| Method ® Tub and Tile Cleaner | Inferior |
| Bio Pac ® Tea Tree Oil Bathroom Cleaner | Inferior |

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

We claim:

1. An acidic hard surface cleaning composition comprising:

a. greater than 2% alkyl polyglucoside;
b. 0.5 to 10% 2-hydroxycarboxylic acid;
c. a fragrance containing 0.05 to 2.0% lemon oil or d-limonene;
d. water; and
e. optionally dyes, colorants, and preservatives;
f. wherein the composition contains no additional surfactant, no additional organic builder, no organic solvent, and no additional disinfectant or sanitizer; and
g. wherein the pH is between 2 and 3.5.

2. The composition of claim 1, wherein the composition comprises greater than 3% alkyl polyglucoside.

3. The composition of claim 1, wherein the composition contains no dye or colorant.

4. The composition of claim 1, wherein the composition contains no additional preservative.

5. The composition of claim 1, wherein the composition contains at least one of dyes, colorants, and preservatives and the dyes, colorants, and preservatives are natural dyes, colorants, and preservatives.

6. The composition of claim 1, wherein the 2-hydroxycarboxylic acid is selected from the group consisting of citric acid, lactic acid, and glycolic acid.

7. The composition of claim 1, wherein the 2-hydroxycarboxylic acid is glycolic acid.

8. The composition of claim 1, wherein the 2-hydroxycarboxylic acid is citric acid.

9. The composition of claim 1, wherein the 2-hydroxycarboxylic acid is a mixture of citric acid and lactic acid.

10. The composition of claim 1, wherein the composition additionally comprises a cellulose thickener.

11. The composition of claim 10, wherein the cellulose thickener comprises xanthan gum.

12. The composition of claim 1, wherein the composition contains substantially no surface modifying agents.

13. The composition of claim 12, wherein the surface modifying agents include organosilanes, waxes, cationic polymers, hydrophobic amphoteric polymers and nanoparticles.

14. The composition of claim 1, wherein the composition is not impregnated in a substrate.

15. A hard surface cleaning composition comprising:

a. 2 to 10% alkyl polyglucoside;
b. 0.5 to 10% 2-hydroxycarboxylic acid;
c. a fragrance containing 0.05 to 2.0% lemon oil or d-limonene;
d. 0.1 to 2.0% xanthan gum;
e. water; and
f. optionally dyes, colorants, and preservatives;
g. wherein the composition contains no additional surfactant, no additional organic builder, no organic solvent, and no additional disinfectant or sanitizer; and
h. wherein the pH is between 2 and 3.5.

16. The composition of claim 15, wherein the composition contains no dye or colorant.

17. The composition of claim 15, wherein the composition contains at least one of dyes, colorants, and preservatives and the dyes, colorants, and preservatives are natural dyes, colorants, and preservatives.

18. The composition of claim 15, wherein the 2-hydroxycarboxylic acid is selected from the group consisting of citric acid, lactic acid, and glycolic acid.

19. The composition of claim 15, wherein the 2-hydroxycarboxylic acid is glycolic acid.

20. The composition of claim 15, wherein the 2-hydroxycarboxylic acid is citric acid.

21. A hard surface cleaning composition consisting essentially of:

a. 2 to 10% alkyl polyglucoside;
b. 0.5 to 10% 2-hydroxycarboxylic acid;
c. a fragrance containing 0.05 to 2.0% lemon oil or d-limonene;
d. optionally a cellulosic thickener;
e. optionally dyes, colorants, and preservatives, wherein the dyes, colorants and preservatives are not derived from petrochemicals;
f. water;
g. wherein the pH is between 2 and 3.5.

* * * * *